United States Patent [19]

Longuet et al.

[11] Patent Number: 5,022,187

[45] Date of Patent: Jun. 11, 1991

[54] DEVICE FOR REGULATING THE GRINDING WEIGHT FOR AN OPHTHALMIC GLASS GRINDING MACHINE

[75] Inventors: Raynald G. M. Longuet, Amfreville la Campagne; Jean-Yves F. P. Pecot, Caudebec les Elbeuf, both of France

[73] Assignee: Briot International, Pont de l'Arche, France

[21] Appl. No.: 568,765

[22] Filed: Aug. 17, 1990

[30] Foreign Application Priority Data

Sep. 27, 1989 [FR] France ..... 89 12645

[51] Int. Cl.[5] ..... B24B 49/00

[52] U.S. Cl. ..... 51/165.74; 51/165.74; 51/101 LG; 51/165.78

[58] Field of Search ..... 51/165.74, 100 R, 101 R, 51/101 LG, 165.74, 165.76, 165.78

[56] References Cited

U.S. PATENT DOCUMENTS 4,612,732 9/1986 Delattre et al. ..... 51/101 LG 4,667,444 5/1987 Langlois et al. ..... 51/101 LG

*Primary Examiner*—Maurina Rachuba

*Attorney, Agent, or Firm*—Martin Smolowitz

[57] ABSTRACT

The device is of the type comprising a carriage slidably and pivotally mounted on a shaft (101), and an arm (102) connected to the carriage and bearing against and slidable along a rail (108) parallel to the shaft (101), the arm (102) bearing against the rail (108) through an element (110) for actuating a sensor (112) mounted on the arm (102), a roller (111) being interposed between the rail (108) and the actuating element (110) and being rotatively mounted on the latter. According to the invention, the actuating element is a rod (110) mounted by a first end (125) of the two ends (125, 113) of the rod on the arm (102) to pivot about a pivot pin (126) which is parallel to the shaft (101) and disposed in the vicinity of the rail (108). The sensor (112) is mounted on the arm (102) and cooperates with one of the two ends (125, 113) of the rod (110). A system (127–131) for balancing the force (F) applied to the rod (110) by the roller (111) is provided.

10 Claims, 1 Drawing Sheet

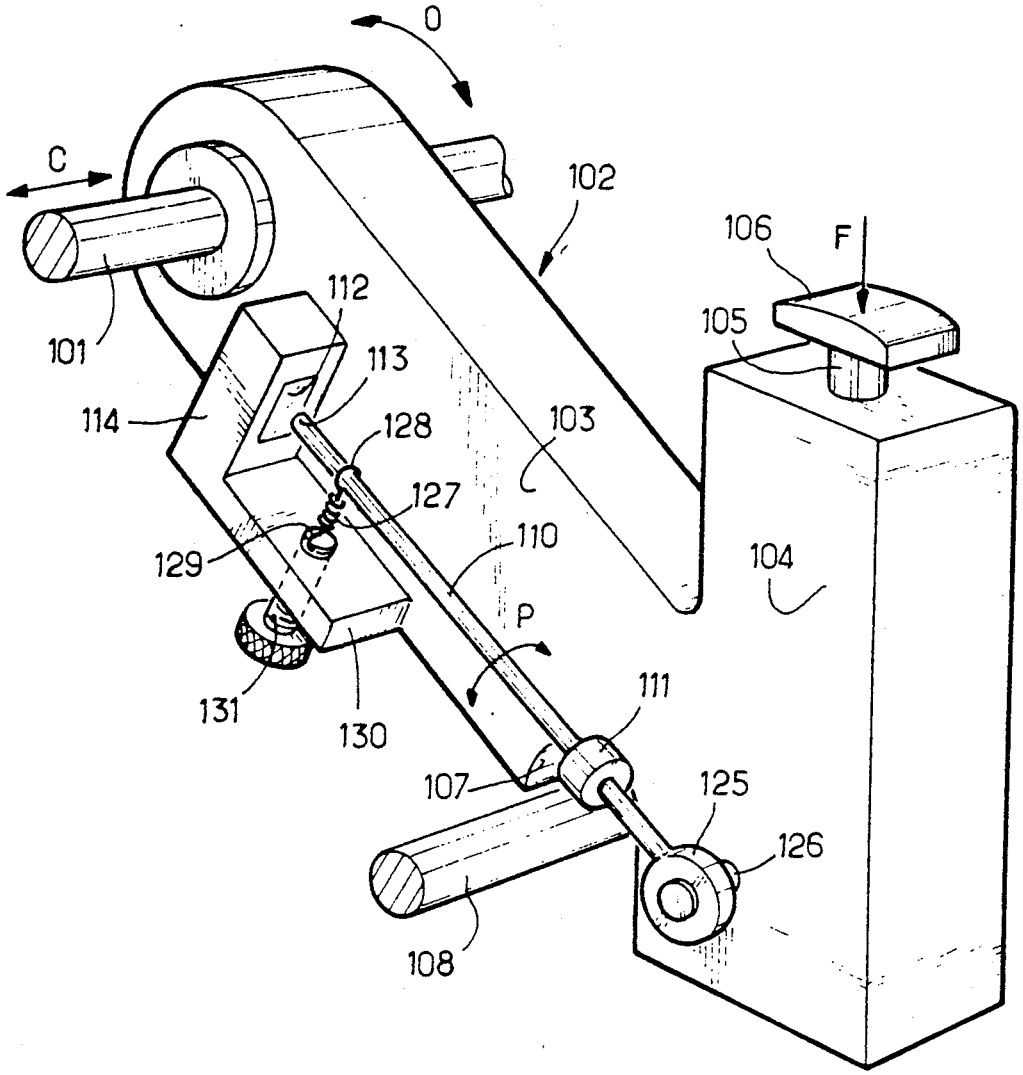
0
C
102
106
F
105
112
113
101
114
128
103
127
110
129
104
P
131
130
111
107
125
126
108

DEVICE FOR REGULATING THE GRINDING WEIGHT FOR AN OPHTHALMIC GLASS GRINDING MACHINE

BACKGROUND OF THE INVENTION

The present invention relates in a general way to machines for grinding ophthalmic glasses, and more particularly to a device for regulating the grinding weight for such machines.

The invention concerns more particularly a device for regulating the grinding weight in a machine for grinding ophthalmic glasses of the type comprising a carriage slidably and pivotally mounted on a shaft, and an arm which is connected to the shaft and bears against and is slidable along a rail parallel to said shaft, the arm bearing against the rail through an element for actuating a sensor mounted on the arm, a roller being interposed between the rail and the actuating element and being mounted on the latter. Such a device was described and represented in the French patent application No. 2,639,276 filed on Nov. 22, 1988 in the name of the applicant.

As described in said patent application and as known per se, a conventional machine for grinding ophthalmic glasses comprises a generally U-shaped carriage which is slidably and pivotally mounted on a first shaft by an intermediate part of the carriage, a second shaft parallel to said first shaft and carrying a group of grinding wheels driven in rotation by a motor, wings of the carriage carrying a third shaft which is parallel to the first and second shafts and is in two parts between which a blank to be ground is maintained, and an arm connected to the carriage and carrying a tracer member against which bears a template mounted on an extension of said third shaft.

In operation, as the blank to be ground is gripped between the two shaft parts, between the wings of the carriage, it is brought into contact with a rotating grinding wheel while being driven in rotation about itself until the blank has been reduced to the dimensions of the template.

This operation for peripherally grinding the blank requires applying the latter against the grinding wheel with a certain force which, in the conventional machines, was produced merely by the weight of the carriage, it being possible if necessary to correct this weight by means of a spring. However, it was found necessary to vary this force in order to regulate the depth of the grinding pass as a function of the nature and/or the thickness of the glass to be ground.

According to a first solution prior to said French patent application No. 2,639,276, a counterweight is employed mounted on the carriage and movable in a direction perpendicular to the shafts in one direction or the other, so as to increase or decrease the force with which the blank is applied against the grinding wheel. In a variant, it is also possible to employ a spring.

In a second solution, described in French patent No. 2,481,635 of the applicant, the arm carrying the tracer member bears against and slides along a rail parallel to the aforementioned shafts, and the tracer member is itself mounted on a jack which bears against a compression spring and is connected to a displacment sensor connected to an electronic device controlling the jack.

These different systems whereby it is possible to control the force with which the blank is applied against the grinding wheel were not fully satisfactory. Indeed, in the case where a counterweight or a spring is used, the regulation is effected manually and this necessarily results in a certain imprecision which cannot be ignored.

In the case of the device disclosed in said French patent No. 2,481,635, it is found that wearing of the abutment of the jack against the compression spring occurs, which results in play producing mechanical deviations.

OBJECTS OF THE INVENTION

The invention described and represented in said French patent application No. 2,639,276 permitted overcoming these drawbacks of the devices of the prior art. For this purpose, there is disclosed a regulating device characterized in that the arm bears against the rail through an element for actuating a sensor mounted on the arm, a roller being interposed between the rail and the actuating element and being rotatable on the latter.

In a first embodiment of the last-mentioned invention, the actuating element is an elastically deformable rod anchored by one end on the arm in the vicinity of the rail, the sensor being also mounted on the arm in facing relation to the other end of the rod.

In another embodiment, the sensor device is of the type comprising stress gauges mounted on a deformable actuating element composed of ceramic, metal or other material.

Although these devices are satisfactory in that they in particular provide a very good regulation of the grinding weight, it was found that a regulating device might be desirable which has a greater capability of adaptation to different parameters of the grinding machine and to the different grinding force and weight magnitudes to be regulated.

SUMMARY OF INVENTION

The present invention provides for this purpose a device for regulating the grinding weight in a machine for grinding ophthalmic glasses, characterized in that the actuating element is a rod which is mounted by a first end of the ends thereof on the arm to pivot about a pin parallel to said shaft and disposed in the vicinity of the rail, the sensor is mounted on the arm and is cooperative with one of said two ends of the rod, and a system for balancing the force applied to the rod by the roller is provided.

According to other features of the invention:

the balancing system comprises a spring having one end connected to the rod and the other end connected to the arm;

the spring is a tension spring said other end of which is adjustably connected to the arm;

the sensor is mounted on the arm and is cooperative with the second end of the rod;

the sensor is mounted on the arm and is cooperative with said first end of the rod;

the roller is rotatively mounted on the rod in the vicinity of the pin by which it is pivotally mounted on the arm;

the sensor is of the Hall-effect type;

the sensor is an optical sensor;

the sensor is an electromagnetic, electric or other sensor.

DESCRIPTION OF INVENTION

The following description, with reference to the accompanying drawing given as a non-limitative example, will explain how the invention can be carried out.

BRIEF DESCRIPTION OF THE DRAWINGS

The single Figure is a partial perspective view of the arm connected to a carriage of a grinding machine, comprising the device for regulating the grinding weight according to the invention.

DETAILED DESCRIPTION OF THE DRAWINGS

With reference to the Figure, the reference numeral 101 designates a shaft on which is slidably and pivotally mounted a U-shaped carriage (not shown) of a conventional ophthalmic glass grinding machine. The arrows C and O denote the directions in which the carriage slides and pivots, and the reference numeral 102 generally designates an arm connected to the carriage. The arm 102 is substantially and generally L-shaped and is connected to the carriage by the end of the longer branch 103 of the arm. The shorter branch 104 of the L-shaped arm extends substantially vertically upwardly.

Mounted inside the shorter branch 104 of the arm 102 is a jack, for example a mechanical rack-type jack (not shown) having a rod 105 which projects axially upwardly in a direction parallel to the vertical direction of the branch 104, and carries a tracer member 106 adapted to receive in bearing relation thereto a template of a glass to be ground, the tracer member cooperating with this template during the grinding operation.

A notch 107, through which freely extends a rail 108 parallel to the shaft 101, is provided in the longer branch 103 of the arm 102 in the vicinity of its connection to the shorter branch 104. A rigid rod 110 extends longitudinally in proximity to the arm 102 in a direction substantially parallel to the direction in which the longer branch 103 extends.

The rod 110 is connected to the arm 102 by a first end 125 thereof, which is pivotally mounted on the arm 102 substantially in the region in which the two branches 103 and 104 are connected. Said rod first end 125 is mounted to be pivotable about a pivot pin 126 mounted on the arm 102, and extending in a direction parallel to the rail 108 and to the shaft 101.

The rigid rod 110 can consequently pivot about its pivot pin 126 in a plane parallel to the planar lateral sides of the arm 102, and therefore in a direction perpendicular to the common direction in which the shaft 101 and the rail 108 extend.

It will be observed that the rod 110 is pivotally mounted on the arm 102 on the opposite side of the rail 108 to the shaft 101 and extends toward the latter just above the rail 108 and in a direction perpendicular to the latter.

A roller 111 is mounted on the rod 110 to rotate about the longitudinal axis of the latter so as to be capable of bearing against the rail 108 and roll along the latter during the sliding movements of the carriage in the direction C.

In the illustrated embodiment, a sensor 112, which is here of the Hall-effect type, is fixed on the longer branch 103 of the arm 102 in the vicinity of the shaft 101 in facing and in opposing relation to the second end 113 of the rod 110. It will be easily understood that the free end 113 comprises for example magnets for actuating the sensor 112, the latter being mounted to be adjustable along two orthogonal axes contained in a plane perpendicular to the planar sides of the arm 102 in a sensor housing 114 in accordance with a known arrangement which is not part of the present invention. Further, it will be understood that the output of the sensor 112 is applied to an adjustable electronic device controlling the jack in the same way as that described in said French patent No. 2,481,635.

According to the invention, a system for balancing the force applied to the rod 110 by the roller 111 is provided.

In the presently-described embodiment, the balancing system comprises a tension coil spring 127 having a loop-shaped first end 128 connected to the rigid rod 110. The other end 129 of the balancing spring 127 is adjustably connected to a lateral plate 130 of the longer branch 103 of the arm 102.

The spring end 129 is fixed to the free end of an adjusting screw 131 which extends through the plate 130 in a tapped hole in which it is screwed. It will easily be understood that rotation of the screw 131 varies the tension of the spring 127 in both directions.

When a force is applied to the tracer member 106 in the direction indicated by arrow F, this force is transmitted to the rod 110 which, owing to the fact that it bears against the rail 108 through the roller 111, tends to pivot about the pivot pin 126 in the clockwise direction as viewed in the Figure.

Owing to the fact that the roller 111 is located close to the pin 126 and to the fact that the rod 110 extends to a particularly great length beyond the roller 111 toward the sensor 112, there is a multiplying effect, for example by ten, on the displacement of the rod free end 113 facing the sensor 112.

The balancing spring 127 has of course for its function to compensate for the force normally applied to the rod 110 pivoting about the pivot pin 126, owing to the weight of the moving assembly when no force is applied to the tracer member 106.

The adjusting screw 131 consequently permits very easily initially adjusting the "zero" of the rod-sensor assembly.

In operation, if the force applied at F varies, the spring 127 extends or contracts and in this way results in a displacement of the free end 113 of the rod 110 relative to the sensor and therefore to the magnets mounted at this end in facing relation to the sensor, as indicated by the arrow P.

When the force applied at F is zero, the sensor and the magnets are centered and no control signal for regulating the jack is produced owing to the initial "zero" adjustment of the device.

By means of the device just described, it is possible to control the jack and in this way the pressure exerted on the template by the tracer member 106 for, for example, partly cancelling out the force exerted by the weight of the carriage on the glass as long as the latter has not been reduced to the dimensions of the template, and totally cancelling it out when the glass has reached the dimension requiring zero grinding.

It is also possible to set the desired pressure in accordance with the nature of the blank (hard or soft).

The scope of the invention is not intended to be limited to the represented embodiment just described.

Thus, for example, the sensor 112 could be connected and fixed to the arm branch 104 in the vicinity of the first end 125 of the rod 110 pivotally mounted on the pivot pin 126, so as to measure the relative rotation or displacement of this end about the pin 126 relative to the arm 102 and convert it into a regulating signal for the jack.

Furthermore, the balancing system may be constructed in many embodiments and permit in particular other initial adjustments, such as for example the position of the point at which the end 128 of the spring 127 acts along the rod 110.

The sensor in the housing 114 could of course also be an optical sensor or a sensor of any other type, its actuating element supporting the arm in a cantilever fashion on the rail or other fixed element.

there

As disclosed in said French patent application No. 2,639,276, there is consequently proposed a regulating device whose principle is based on the conversion of the force F applied to the tracer member 106 into a relative displacment of two elements, by means of a structure comprising at least one actuating element for an elastically deformable sensor interposed between the arm 102 and the rail 108.

What is claimed is:

1. Device for regulating a glass grinding weight in a machine for grinding ophthalmic glasses, said device comprising a first shaft, a rail parallel to said first shaft, a carriage mounted to be slidable and pivotable on said first shaft, an arm connected to the carriage, a sensor mounted on said arm, a rod for actuating said sensor mounted on said arm, said arm bearing against said rail through said actuating rod, a roller interposed between said rail and said actuating rod and rotatively mounted on said actuating rod, said rod having a first end and a second end opposed to said first end, a pivot pin pivotally mounting said first end of said rod on said arm, said pivot pin being parallel to said shaft and disposed in the vicinity of said rail, said sensor being mounted on said arm and being cooperative with one of said ends of said rod, said device further comprising a system for balancing force applied to said rod by said roller.

2. Device according to claim 1, wherein said balancing system comprises a balancing spring having a first end connected to said rod and an opposite second end connected to said arm.

3. Device according to claim 2, wherein said spring is a tension spring and said second end of the spring is adjustably connected to said arm.

4. Device according to claim 1, wherein said sensor is mounted on said arm and is cooperative with said second end of said rod.

5. Device according to claim 1, wherein said sensor is mounted on said arm and is cooperative with said first end of said rod.

6. Device according to claim 1, wherein said roller is rotatively mounted on said rod in the vicinity of said pivot pin.

7. Device according to claim 1, whereing said sensor is of the Hall-effect type.

8. Device according to claim 1, wherein said sensor is an optical sensor.

9. Device according to claim 1, wherein said sensor is an electromagnetic sensor.

10. Device according to claim 1, wherein said sensor is an electric sensor.

* * * * *